United States Patent [19]

Neilsen

[11] 4,193,582

[45] Mar. 18, 1980

[54] JACK FOR LIFTING OBJECTS

[76] Inventor: Roger P. Neilsen, 2943 Hillegass, Berkeley, Calif. 94705

[21] Appl. No.: 925,950

[22] Filed: Jul. 19, 1978

[51] Int. Cl.[2] ..... B66F 7/22

[52] U.S. Cl. ..... 254/131

[58] Field of Search ..... 254/8 R, 8 B, 131; 214/373, 390

[56] References Cited

U.S. PATENT DOCUMENTS

| | | | |
|---|---|---|---|
| 3,667,728 | 6/1972 | Garelick | 254/131 |
| 4,113,235 | 9/1978 | Hartman | 254/131 |

*Primary Examiner*—Robert C. Watson

*Attorney, Agent, or Firm*—Bielen and Peterson

[57] ABSTRACT

A jack for lifting objects especially useful for lifting motorcycles utilizing a cross member having two spaced substantially parallel legs connected thereto forming a support member. A lever arm detachably connects to the support member. Movement of the lever arm from an upright position to a ground contacting position lifts the cross member from the ground, the weight of the lifted object urging the lever arm into the ground surface.

12 Claims, 6 Drawing Figures

FIG.1
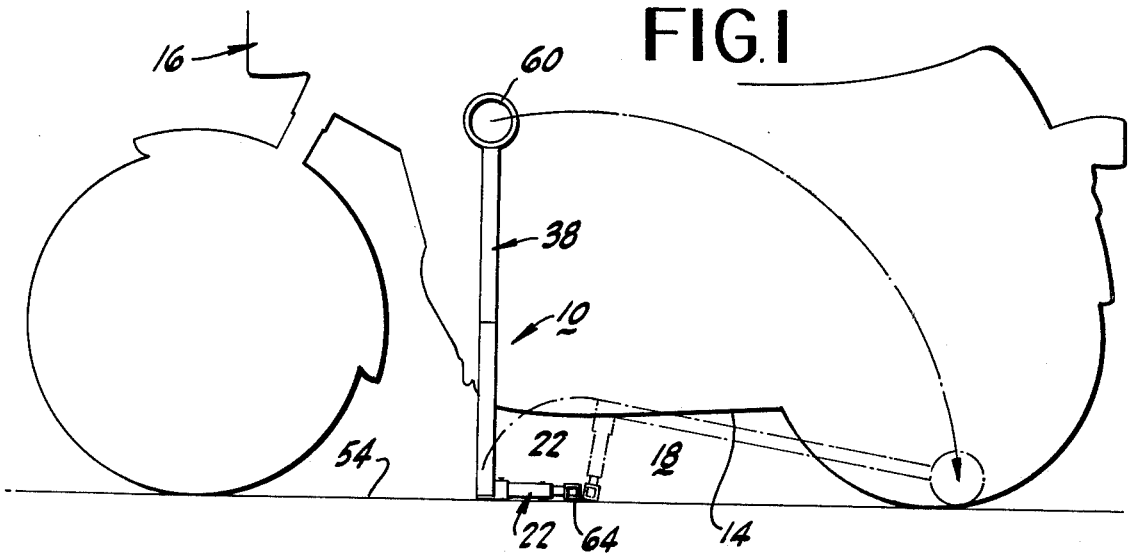
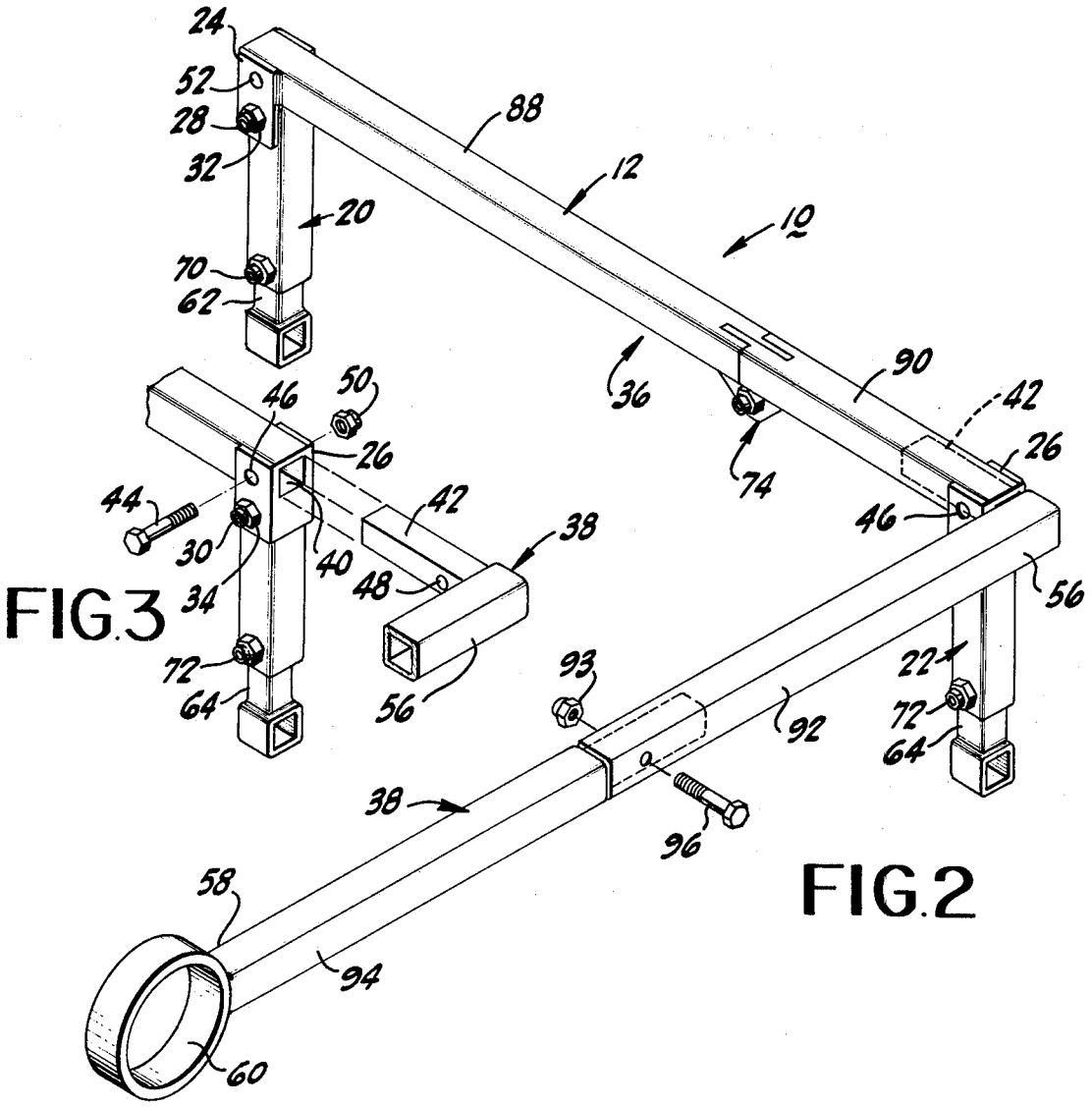
FIG.3
FIG.2

FIG-4
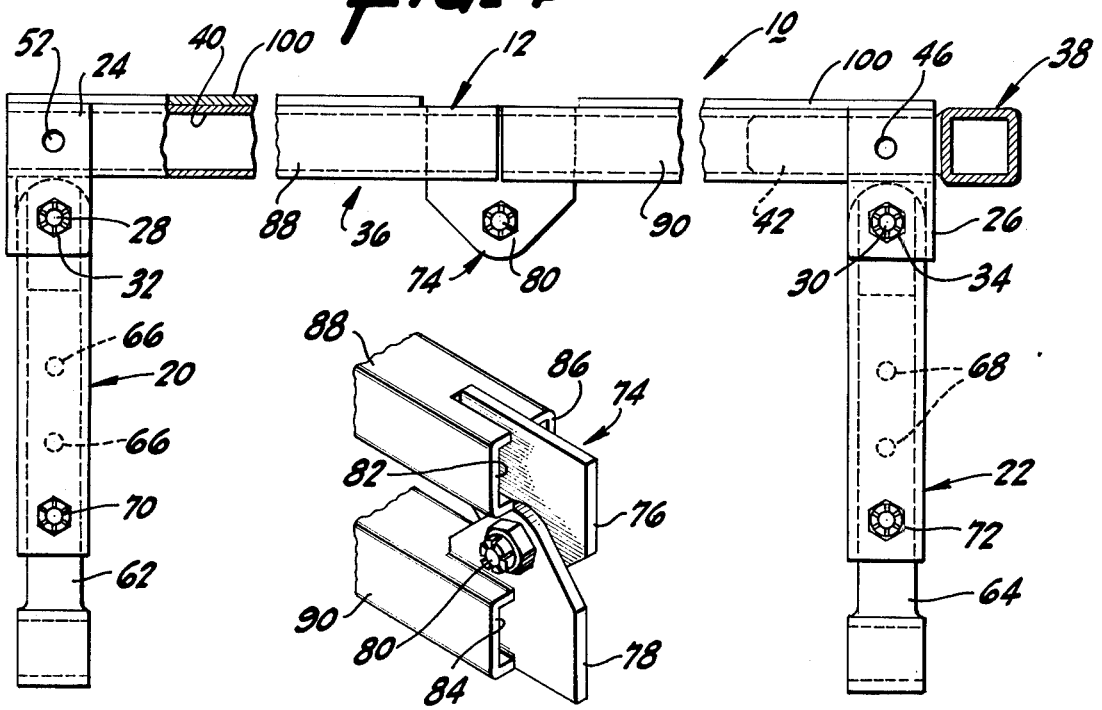
FIG-5
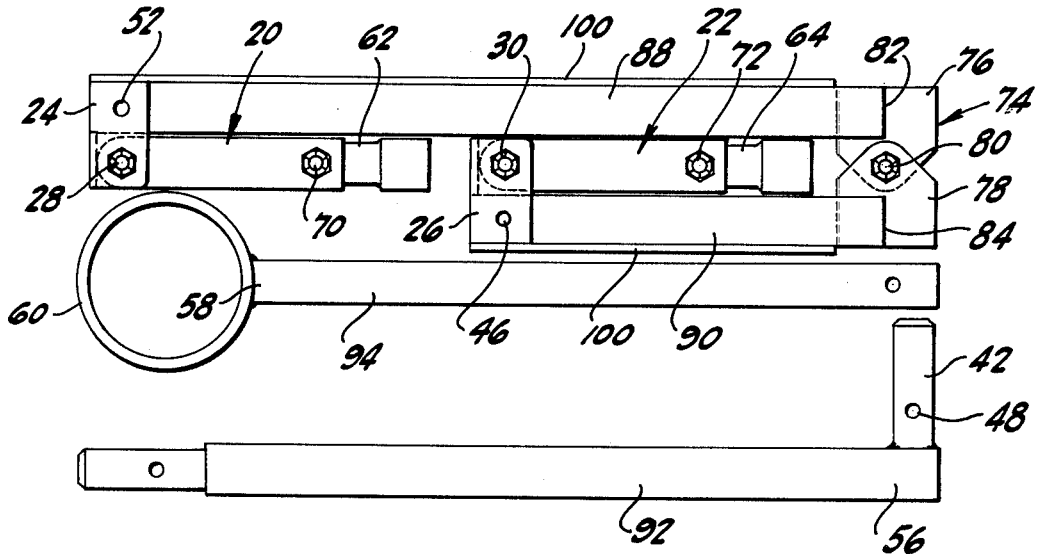
FIG-6

JACK FOR LIFTING OBJECTS

BACKGROUND OF THE INVENTION

The present invention relates to a novel jack for raising object from a ground surface.

Maintenance and repair of mechanical objects almost invariably require elevation of the object to create working space for the repair person. Prior devices have included ramps, sometimes combined with a pit beneath the same. Also, various jacks employing the screw, rack and lever, and hydraulic principals are known.

Although the prior devices have been successful in certain situations, they have not been applicable to all cases requiring lifting. For instance, there is a need for a compact jack having minimal moving parts to lift vehicles such as motorcycles for the performance of work particularly associated with the wheels or gear train. In addition, a portable jack which is reliable in remote areas of travel is not known to be available for motorcycle usage.

SUMMARY OF THE INVENTION

In accordance with the present invention, a novel jack for raising objects from a ground surface is provided.

The jack of the present invention is particularly useful for motorcycles and includes a cross member which spans the underside of the object to be lifted. A pair of substantially parallel spaced legs angularly fix to the cross member to form a support member.

A lever arm detachably connects to the support member. Movement of the lever arm from an upright position to a position where the lever arm contacts the ground surface, raises the cross member and the object above the surface. The weight of the object on the lifted cross member urges the lever arm into contact with the ground surface during the final portion of the lever's travel. The lever maintains contact with the ground surface under the weight of the raised object. The lifted object thus aids in the establishment and maintains the lifted object in a balanced position.

The present invention may also be deemed to include a lever arm which may detachably connect to the support member in at least two juxtaposed positions. This feature allows facile manipulation of the jack by right and left handed persons as well and permits lifting of irregularly or unorthodoxly shaped objects. The lever arm may be formed with first and second end portions, where the first end portion connects to the support member and the second end portion has a gripping portion to aid the movement of the lever between its positions. The gripping portion on the second end portion of the lever may be a ring whose axis is parallel to the ground surface. Thus, the second end portion of the lever is readily available to the user on soft terrain, and maximum torque applies when jacking or lifting occurs.

The jack may include legs adjustable in length with respect to the cross member for accomodating objects having various clearances above the ground surface. In this regard, the legs may also hingedly attach to the cross member to fold along the length of the cross member during storage. The cross member may be constructed in two sections hingedly attached to each other. Further, formation of a two piece lever arm such that the length of one of the cross member sections and the combined length of one of the legs and the other cross member section is no larger than any of the lever arm sections, creates a neatly collapsible and portable jack.

The jack may be easily adaptable to motorbikes, motorscooters, and motorcycles, but may be employed to lift similar objects without alteration of the structural components thereof.

It is therefore an object of the present invention to provide a jack having minimal moving parts which is readily adaptable to lift objects above a ground surface and to maintain the object in such lifted position for inspection, maintenance, and repair purposes.

It is another object of the present invention to provide a jack useable for raising motorcycles and the like.

It is yet another object of the present invention to provide a jack which adjusts its lifting capability according to the clearance available under the object and which may be activated in any of several positions.

Another object of the present invention is to provide a jack which is easily portable and compactly collapsible, being particularly useable in remote areas and on soft terrain.

The invention possesses other objects and advantages especially as concerns particular features and characteristics thereof which will become apparent as the specification continues.

The invention and its embodiments may be better understood by reference to the drawings described below.

BRIEF DESCRIPTION OF THE DRAWINGS

FIG. 1 is a side elevational view of the jack in operation on a motorcycle, the lever arm movement depicted in phantom.

FIG. 2 is an isometric view of the jack.

FIG. 3 is a broken isometric exploded view of the connection mechanism between the lever arm and support member of the jack.

FIG. 4 is a broken side view of the jack support member partially in section.

FIG. 5 is a broken isometric view of the hinge mechanism of the jack cross member.

FIG. 6 is a top plan view of the jack in a collapsed state.

DESCRIPTION OF THE PREFERRED EMBODIMENTS

The jack in its entirety is denoted in the figures by reference character 10 and includes as one of its elements a cross member 12 adapted to span the underside 14 of the object 16 being raised by the jack 10, FIG. 1 and FIG. 2. As depicted in FIG. 1, the object 16 being lifted by jack 10 is a motorcycle, however, jack 10 will lift any like object having a clearance space 18 large enough to accomodate jack 10.

A pair of substantially parallel legs 20 and 22 angularly fix to cross member 12. The preferred embodiment fixes legs 20 and 22 to cross member 12 at approximately 90° to the axis of cross member 12.

As shown in FIG. 3, legs 20 and 22 are hingedly attached to cross member 12. Brackets 24 and 26 affix to cross member 12 by welding or otherwise integrally forming cross member 12 and brackets 24 and 26. Bolts 28 and 30 and nuts 32 and 34 serve to pivotally hold legs 20 and 22 within brackets 24 and 26. The long axis of bolts 28 and 30 are the pivoting axis of legs 20 and 22. Walls 36 and 38 bias the pivoting of legs 20 and 22 toward the center of cross member 12, FIG. 6. Although, legs 20 and 22 are substantially parallel, a slight camber is desirable for the sake of stability.

Legs 20 and 22 and cross member 12 form support member 36. A lever arm 38 detachably connects to support member 36. As illustrated in the drawings, cross member 12 has an internal opening 40 along its entire length. Lever arm 38 includes stub 42 which fits within opening 40. Bolt 44 passes through opening 46 and another aligned opening (not shown) as well as aligned opening 48 in stub 42. Nut 50 threads onto bolt 44 resulting in the connection of lever arm 38 to cross member 12. As may be deduced, lever arm 38 may connect to support member 36 on the end having leg 20 by the utilization of bolt 44 and nut 50 through opening 52 and another aligned opening (not shown) in bracket 24. Lever arm 38 may be connected to support member 36 in at least two juxtaposed positions, even though several other workable positions are possible.

Lever arm 38 moves between an upright position and to a ground contacting position, FIG. 1. Since the drawings show a straight lever arm, ground surface contacts takes place at the very end. Such movement of the lever arm 38 will raise object 16 whose weight will aid in the movement of the lever arm 38 and urge the lever arm into contact with ground surface 54.

Lever arm 38 may be deemed to have a first end portion 56 and second end portion 58. The first end portion 56 connects to support member 36, while the second end portion 58 has gripping portion 60. As shown, gripping portion 60 may take the form of a ring whose diameter exceeds the width and breadth of the lever arm 38. By orienting the axis of the ring gripping portion 60 substantially parallel to the ground surface, the user's hand is best able to maneuver the jack 10. The gripping portion also extends above a soft ground surface 54 when object 16 exerts its force on the lever arm 38, i.e., in mud, sand, foliage and the like.

To better accomodate objects 16 having variously sized clearance spaces 18, legs 20 and 22 are adjustable in length with respect to cross member 12. Legs 20 and 22 embrace pedestals 62 and 64, best shown in FIG. 5. Pedestals 62 and 64 have a number of predetermined openings 66 and 68. The upper part of legs 20 and 22 include a pair of aligned openings. Pins 70 and 72 pass through the aligned openings in 20 and 22 as well as one of the desired openings 66 and 68 pedestals 62 and 64. Thus, a certain part of pedestals 62 and 64 extend below the upper part of legs 20 and 22 providing the desired height of the legs.

FIG. 6 illustrates the compact collapsibility of jack 10. Hinge 74 in cross member 12, FIG. 5, includes a pair of wings 76 and 78 which pivot on pin 80. Downward pressure on cross member 12 is taken up on U-shaped surfaces 82 and 84, and 86 and one not shown, symmetrical to surface 84. Cross member 12 is thus formed of two sections 88 and 90.

Lever arm 38 may also be formed into sections 92 and 94 connected by bolt 96 and nut 98.

The elements of jack 10 may be constructed such that the length of one section 88 of cross member 12 and the combined length of leg 20 or 22 and section 90 are no larger than either lever arm 38.

Sections 92 and 94, FIG. 6, indicates the folding of the various elements of jack 10 into an easily packaged portable jack 10.

A layer of cushioning material 100 may be added to the jack to prevent damage to the under surface of object 16.

In operation the user slips the support member 12 beneath the object 16 through clearance space 18. The lever arm 38 will be in an upright position at this time. The lever arm 38 is then pulled down into contact with ground surface 54 and object 16 rises above the surface 54. Reversal of the movement of lever arm 38 will again lower the object 16 to rest on surface 54.

To collapse the jack 10, the user removes lever arm 38 from support member 36. Legs 20 and 22 are folded inwardly and sections 88 and 90 are also folded about hinge 74. Lever arm 38 is broken into sections 92 and 94 by removal of bolt 96 and nut 98. The combined elements may be placed in a package such as a bag.

The support member and lever arm may be fashioned of any rigid material such as stainless steel, cast iron, aluminum and the like.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A jack for lifting an object particularly a motorcycle and the like from a ground surface comprising:

a. cross member adapted to span the underside of the object;

b. a pair of substantially parallel legs, angularly fixed to said cross member and spaced along the span of said cross member, said cross member and said legs forming a support member;

c. a lever arm detachably connectable to said support member in at least two juxtaposed positions adapted for movement from an upright position to a position where at least a portion of said lever arm contacts the ground surface, said lever arm having a first end portion connected to said support member and a second end portion having a ring whose diameter exceeds the width and breadth of said lever arm, the axis of said ring being oriented substantially parallel to the ground surface; and d. means for utilizing the weight of the object being lifted to urge said contact of said at least a portion of said lever arm with the ground surface.

2. The jack of claim 1 in which each of said legs is adjustable in length with respect to said cross member.

3. The jack of claim 1 in which said legs are hingedly attached to said cross member and said cross member is formed of two sections hingedly attached to each other, said lever arm being formed of two sections readily attachable to each other, the length of one of said cross member sections and the combined length of one of said legs and the other of said cross member sections being no larger than any of said lever arm sections.

4. The jack of claim 3 in which said lever arm detachably connects to said support member in at least two juxtaposed positions.

5. The jack of claim 4 in which said lever arm has a first end portion and a second end portion, said first end portion connected to said support member and said second end portion having a gripping portion to aid the movement of said lever arm between said upright and ground contacting positions.

6. The jack of claim 5 in which said lever arm gripping portion is a ring whose diameter exceeds the width and breadth of said lever arm, the axis of said ring oriented substantially parallel to the ground surface.

7. The jack of claim 6 in which each of said legs is adjustable in length with respect to said cross member.

8. A jack for lifting an object particularly a motorcycle and the like from a ground surface comprising:

a. cross member adapted to span the underside of the object, said cross member being formed of two sections hingedly attached to each other;

b. a pair of substantially parallel legs, angularly fixed to said cross member and spaced along the span of said cross member, said cross member and said legs forming a support member, said legs being hingedly attached to said cross member;

c. a lever arm connected to said support member and adapted for movement from an upright position to a position where at least a portion of said lever arm contacts the ground surface, said lever arm being formed of two sections readily attachable to each other, the length of one of said cross member sections, and the combined length of one of said legs and the other of said cross member sections being no larger than any of said lever arm sections.

9. The jack of claim 8 in which said lever arm detachably connects to said support member in at least two juxtaposed positions.

10. The jack of claim 9 in which said lever arm has a first end portion and a second end portion, said first end portion connected to said support member and said second end portion having a gripping portion to aid the movement of said lever arm between said upright and ground contacting positions.

11. The jack of claim 10 in which said lever arm gripping portion is a ring whose diameter exceeds the width and breadth of said lever arm, the axis of said ring oriented substantially parallel to the ground surface.

12. The jack of claim 8 in which said lever arm detachably connects to said support member.

* * * * *